United States Patent [19]

Hensler

[11] Patent Number: 4,718,317

[45] Date of Patent: Jan. 12, 1988

[54] HOSE COUPLING WRENCH

[75] Inventor: Roy F. Hensler, 10523 127th Ave. N., Largo, Fla. 33543

[73] Assignee: Roy F. Hensler, Largo, Fla.

[21] Appl. No.: 898,659

[22] Filed: Aug. 21, 1986

[51] Int. Cl.[4] ..... B25B 13/48

[52] U.S. Cl. ..... 81/176.3; 81/407; 81/416

[58] Field of Search ..... 81/176.1, 176.2, 176.3, 81/9.24, 415, 416, 342, 347, 355, 407, 484, 300, 16, 57.32

[56] References Cited

U.S. PATENT DOCUMENTS

| | | | |
|---|---|---|---|
| 258,636 | 3/1881 | Boyko | 81/176.1 |
| 378,229 | 2/1888 | Finch | 81/57.32 |
| 455,606 | 7/1891 | Byrne | 81/176.1 |
| 755,569 | 3/1904 | Freeland | 81/57.32 |
| 1,040,982 | 10/1912 | Ingerham | 81/176.1 |
| 1,402,391 | 1/1922 | Baldus | 81/57.32 |
| 1,406,331 | 2/1922 | Bartelt | 81/57.32 |
| 1,406,531 | 2/1922 | Brown | 81/415 |
| 1,708,147 | 4/1929 | Miller | 81/57.32 |
| 2,375,270 | 5/1945 | Yonkers | 81/57.32 |
| 2,599,489 | 6/1952 | Schmidt | 81/9.24 |
| 3,156,141 | 11/1964 | Pluntz | 81/57.32 |
| 3,833,953 | 9/1974 | Fisher | 81/415 |
| 4,478,532 | 10/1984 | Puro | 81/416 |

*Primary Examiner*—Frederick R. Schmidt
*Assistant Examiner*—Bradley I. Vaught
*Attorney, Agent, or Firm*—William M. Hobby, III

[57] ABSTRACT

A hose coupling wrench apparatus includes first and second movable wrench members, each having a handle and an arcuate arm attached thereto. The arcuate arms of each wrench member have arcuate slots therein, and each has a hose coupling engaging portion on each end of each arcuate arm. A slider member connects the two arcuate wrench portions together in a predetermined spaced relationship to each other to allow the wrench portions to slide one relative to the other. The slider member has a pair of curved sliding blocks on each end thereof, with each block sliding in the slot of one wrench portion and supported on one side of the arm by the slider member and on the other by fastening members. The hose coupling wrench can engage hose coupling sections with each movable wrench member. One wrench member can be moved relative to the other to couple or uncouple a hose coupling.

8 Claims, 5 Drawing Figures

HOSE COUPLING WRENCH

BACKGROUND OF THE INVENTION

The present invention relates to hose coupling wrenches and especially to a hose coupling wrench for rapidly coupling or uncoupling large hoses.

In the past, it has been common to provide various types of hose couplings for coupling hoses such as fire hoses to fire trucks or to other fire hoses for extending their length. These couplings generally are of a quick coupling type, such as Bayonet couplings for rapidly attaching and removing connected hoses, or for rapidly attaching or removing a hose attached to a fixed coupling. The couplings may be difficult to remove so that special tools are sometimes adapted for attaching and removing the coupling.

In the past, various U.S. Patents have utilized dual handle wrenches and these include U.S. Pat. No. 1,708,147 to Miller for a tappet wrench in which two wrench portions are interconnected with a link sliding in a slide in one of the wrench portions for rotating bolts in opposite directions. In U.S. Pat. No. 1,572,986 to Brewster, interconnected pipe tongs are used for coupling and uncoupling to a pipe. The two handle portions are connected in a different manner from the present invention. In U.S. Pat. No. 2,599,489 to Schmidt a pair of handles have pronged ends, while U.S. Pat. No. 2,375,270 to Yonkers shows a pair of interconnected wrenches. Similarly, U.S. Pat. No. 3,156,141 to Pluntz shows a pair of interconnected wrenches. U.S. Pat. No. 1,402,391 to Baldus has a pair of pliers interconnected with a wrench for adjusting valves, while U.S. Pat. No. 378,299 to Finch has interconnected wrench handles connected between the handles. The Freeland Pat. No. 755,569 has a ratchet wrench having two ratcheting handles for ratcheting in opposite directions, while the Bartelt U.S. Pat. No. 1,406,331 has a double wrench that has connections between the handles between vertical and horizontal slots.

The present invention advantageously is specifically directed towards coupling and uncoupling snap tight hose couplings, utilizing two identical wrench portions, having handles connected to arcuate coupling engaging arms, and having coupling surfaces on each end of each arm. The arcuate arms have arcuate slots therein for interconnecting to a slider for simultaneously twisting portions of a pipe coupling in opposite directions.

SUMMARY OF THE INVENTION

The present invention relates to a hose coupling wrench, having first and second movable wrench members, each having a handle and an arcuate arm attached to the handle. Each arcuate arm has at least one pipe coupling engaging member thereon and an arcuate slot formed therein. A slider member is located between the first and second movable wrench members for spacing the first and second wrench members at a predetermined distance thereapart. The slider member has a pair of sliding block portions on each end thereof, having a curved shape so that each sliding block is shaped to fit in one arcuate slot of one movable wrench member, so that each movable wrench member can slide thereon relative to the other. The slider member is attached to the wrench members through nuts or washers or other attaching means located on the opposite side of the wrench member from the slider member, and attached to the slider member through the arcuate slot in the arcuate arm of the wrench member. The pipe coupling engaging portion of the arcuate arms may be ledges formed thereon for grabbing protruding studs on hose couplings.

BRIEF DESCRIPTION OF THE DRAWINGS

Other objects, features and advantages of the present invention will be apparent from the written description and the drawings in which.

DESCRIPTION OF THE PREFERRED EMBODIMENTS

Figure 1:
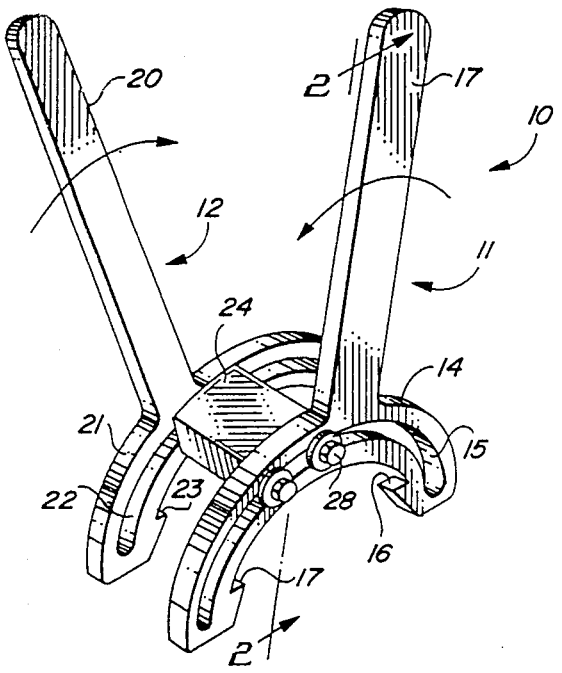
FIG. 1 is a perspective view of a hose coupling wrench in accordance with the present invention.
Figure 2:
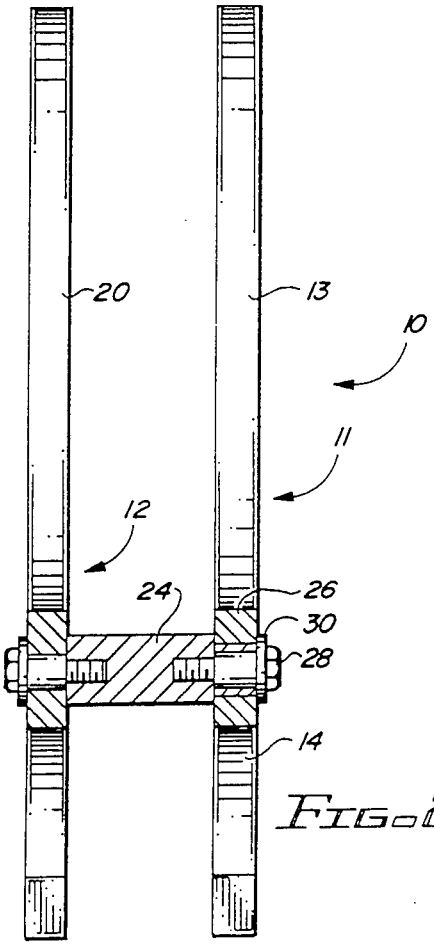
FIG. 2 is a sectional view taken on the line 2—2 of FIG. 1.
Figure 3:
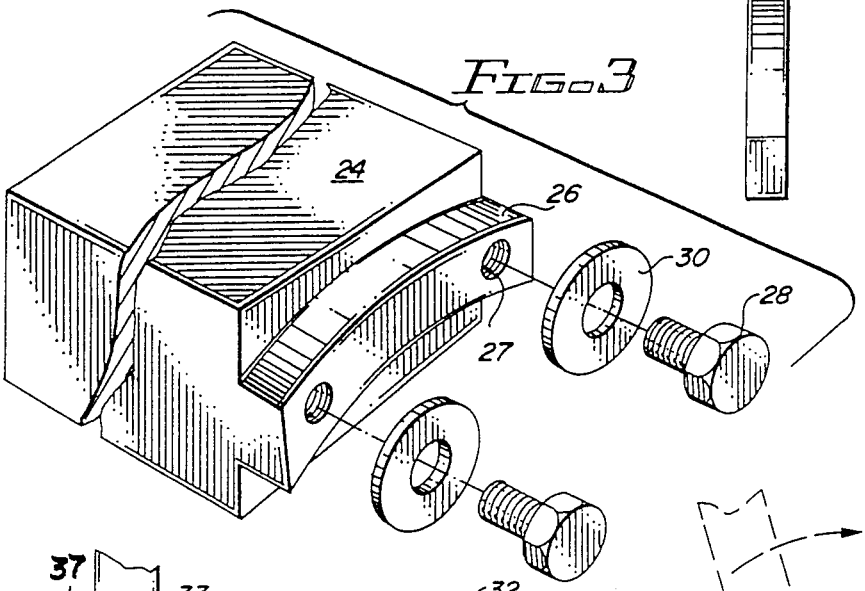
FIG. 3 is an exploded view of the slider block of the hose coupling wrench of FIGS. 1 and 2.

Referring to the drawings, a hose coupling wrench 10 is illustrated having a first movable wrench member 11 and a second movable wrench member 12. The wrench member 11 has a handle 13 connected perpendicular to a tangent of an arcuate arm 14. The arcuate arm 14 has an arcuate slot 15 therein. The wrench member 11 has stud engaging members 16 and 17 on each end of the arcuate arm 14. The wrench member 12 has a handle 20 connected perpendicular to a tangent to the arcuate arm 21. The arcuate arm 21 has an arcuate slot 22 therein and a hose coupling engaging ledge 23 on each end of the arcuate arm 21. A slider member 24 is mounted between the wrench portions 11 and 12 and is connected to each wrench portion to space the wrench portions 11 and 12 at a predetermined distance. The slider 24 has arcuate sliding block portions 26 on each side thereof shaped to fit in the arcuate slots 15 and 22 of the wrench members 11 and 12 and to slide therein, or rather to allow the wrench portions 10 and 12 to slide on the sliding block portions 26. The sliding block portions 26 may have a pair of threaded bores 27 therein for attaching bolts 28 through washers 30. A pair of bolts 28 and washers 30 are located on each side of the slider block 24 and attach through the outside of the slots 15 and 22 into the slider block threaded bores 27, and holds the wrench portions 11 and 12 together in a spaced relationship while allowing each wrench portion 11 to move in an opposite direction to the other wrench member 12.

Figure 4:
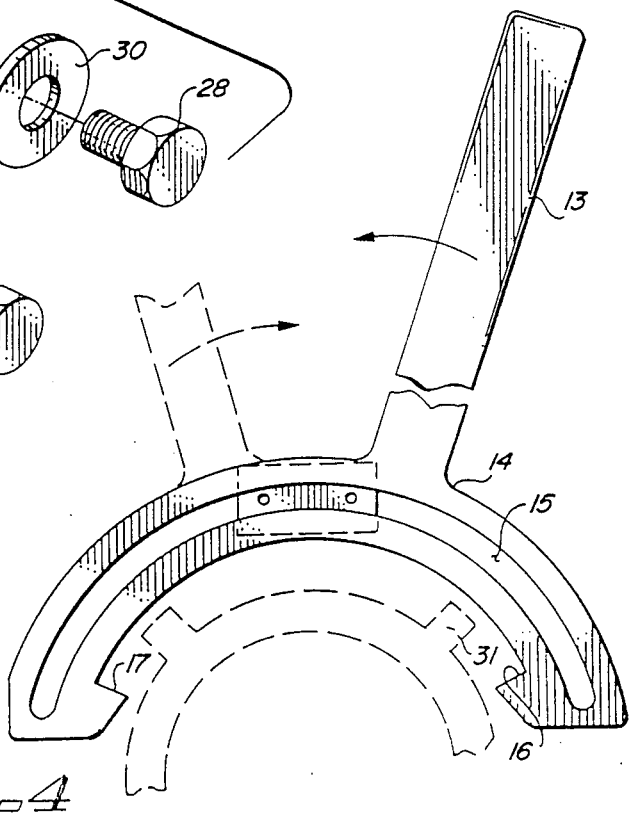
FIG. 4 is a side elevation of the hose coupling wrench of FIGS. 1 and 2 mounted adjacent a phantom hose coupling.

In operation, the wrench portions 11 and 12 are placed on the pipe coupling so that each one engages one or more studs or dogs 31 illustrated in FIG. 4, and by rotating the wrench portions 11 and 12 in opposite directions, allows the rapid uncoupling or coupling of the pipe coupling together.

Figure 5:
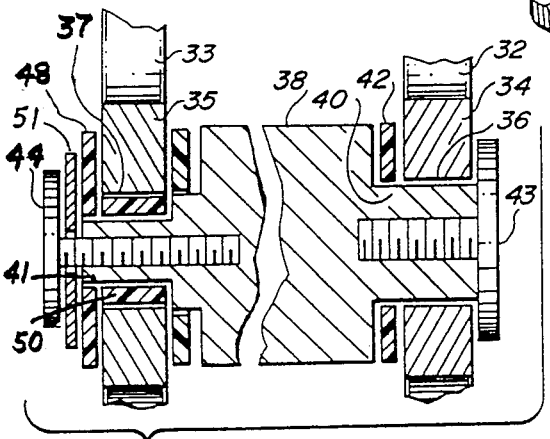
FIG. 5 is a sectional view of an alternate embodiment of a hose coupling wrench slider member.

FIG. 5 shows a slightly modified embodiment having a pair of wrench portions 32 and 33 each having an arcuate arm 34 and 35, having arcuate slots 36 and 37 therein. A slider member 38 has slider block 40 on one side and block 41 on the other side thereof. This embodiment has interior washers 42 placed adjacent the slider block on the inside thereof and a pair of disk headed bolts 43 and 44 are bolted into the slider block 38 on each side thereof. An exterior washer 48 and an interior sliding surface 50 are mounted for the slider block 38 to slide in an auxiliary sliding washer 51 is mounted between the disk 44 and the sliding block member 41. This embodiment allows sliding bushings or bearings on the side being pulled relative to the other to reduce the wear on the wrench.

It should be clear at this point that a hose coupling wrench has been provided for quickly coupling and uncoupling fire hoses and the like in which the hose couplings are rotated in opposite directions relative to each other. It should, however, be clear that the present invention is not to be considered limited to the forms shown which are to be considered illustrative rather than restrictive.

I claim:

1. A hose coupling wrench comprising:

a first movable wrench member having a handle and an arcuate arm attached thereto, the arcuate arm having at least one hose coupling engaging member thereon and one arcuate slot formed therein;

a second movable wrench member having a handle and an arcuate arm attached thereto, the arcuate arm having at least one hose coupling engaging member thereon and an arcuate slot formed therein;

a slider member located between said first and second movable wrench members for spacing said first and second movable wrench members in a predetermined spaced distance from each other, said slider member having a pair of sliding blocks formed on two edges thereof, one of said sliding blocks being positioned in said one arcuate slot in said first movable wrench member and the second slidable block being positioned in said arcuate slot of said second movable wrench member;

an attaching means for movably attaching said slider member to said first and second movable wrench members, whereby said first and second wrench members can slide relative to each other in guided paths defined by said respective arcuate slots whereby said first and second hose coupling engaging members contact studs on a pipe coupling to effect rotation and subsequent coupling or uncoupling.

2. A hose coupling wrench in accordance with claim 1 in which at least one bolt is bolted into each side of said slider member sliding blocks through said wrench member arcuate slot for holding said first and second movable wrench members to each side of said slider member.

3. A hose coupling wrench in accordance with claim 2 in which each bolt has a washer thereon located on the side of said movable wrench member opposite said slider member.

4. A hose coupling wrench in accordance with claim 3 in which each said slider member sliding block is an arcuate block having the same curvature as said arcuate slot in each movable wrench member.

5. A hose coupling wrench in accordance with claim 4 in which said first and second movable wrench member handles, each extend perpendicular to a tangent of the arcuate arem.

6. A hose coupling wrench in accordance with claim 5 in which said slider block is attached to said first and second wrench members with disk headed bolts.

7. A hose coupling wrench in accordance with claim 6 in which one said wrench member has sliding bushings thereon for reducing wear on said slider member sliding block.

8. A hose coupling wrench in accordance with claim 7 in which said slider member is a rectangular block having an arcuate sliding block portion formed on each end thereof and having a pair of threaded bores extending into each sliding block on each side of said slider member.

* * * * *